US011710449B2

(12) United States Patent
Kim et al.

(10) Patent No.: US 11,710,449 B2
(45) Date of Patent: Jul. 25, 2023

(54) DISPLAY DEVICE AND DRIVING METHOD THEREOF

(71) Applicant: Samsung Display Co., Ltd., Yongin-Si (KR)

(72) Inventors: Jin Pil Kim, Yongin-si (KR); Kang Hee Lee, Yongin-si (KR); Joon Chul Goh, Yongin-si (KR); Jae Sung Bae, Yongin-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 0 days.

(21) Appl. No.: 17/831,272

(22) Filed: Jun. 2, 2022

(65) Prior Publication Data

US 2023/0048619 A1 Feb. 16, 2023

(30) Foreign Application Priority Data

Aug. 13, 2021 (KR) ..... 10-2021-0107574

(51) Int. Cl.
*G09G 3/32* (2016.01)

(52) U.S. Cl.
CPC ..... *G09G 3/32* (2013.01); *G09G 2320/0257* (2013.01); *G09G 2320/0276* (2013.01)

(58) Field of Classification Search
CPC ..... G09G 3/32; G09G 2320/0257; G09G 2320/0276
See application file for complete search history.

(56) References Cited

U.S. PATENT DOCUMENTS

| | | | | |
|---|---|---|---|---|
| 7,782,281 | B2 * | 8/2010 | Oh | G09G 3/3406 345/87 |
| 8,576,157 | B2 * | 11/2013 | Bae | G09G 3/3611 345/617 |
| 8,686,925 | B2 * | 4/2014 | Chung | G09G 3/3291 345/76 |
| 8,817,039 | B2 * | 8/2014 | Zhang | H04N 9/67 358/448 |
| 9,135,865 | B2 * | 9/2015 | Yang | G09G 3/3406 |
| 9,406,113 | B2 * | 8/2016 | Kobiki | G06T 5/40 |
| 9,524,664 | B2 * | 12/2016 | Furihata | G09G 3/2007 |
| 9,626,893 | B2 | 4/2017 | Kim | |
| 10,262,604 | B2 * | 4/2019 | Kuwajima | G09G 3/3648 |
| 10,847,092 | B2 | 11/2020 | Bae et al. | |
| 11,398,173 | B2 * | 7/2022 | Han | G09G 3/006 |
| 2005/0140631 | A1 * | 6/2005 | Oh | G09G 3/3611 345/89 |

(Continued)

FOREIGN PATENT DOCUMENTS

| | | | |
|---|---|---|---|
| KR | 10-2019-0062680 | A | 6/2019 |
| KR | 10-2068263 | B1 | 1/2020 |

*Primary Examiner* — Michael J Jansen, II
(74) *Attorney, Agent, or Firm* — Innovation Counsel LLP

(57) ABSTRACT

A display device includes an afterimage compensator generating output grayscales by applying at least one of first and second weights to input grayscales when the input grayscales correspond to a still image, and pixels displaying an image based on the output grayscales. The afterimage compensator applies the first weight having an initial value greater than 1 to the input grayscales of a first group, and converges the first weight to 1, and applies the second weight having initial values less than 1 to the input grayscales of a second group, and converges the second weights to 1.

20 Claims, 12 Drawing Sheets

(56) References Cited

U.S. PATENT DOCUMENTS

| | | | | |
|---|---|---|---|---|
| 2007/0126723 | A1* | 6/2007 | Hong | G09G 3/3648 345/204 |
| 2008/0284691 | A1* | 11/2008 | Chung | G09G 3/3225 345/76 |
| 2009/0115757 | A1* | 5/2009 | Bae | G09G 3/3406 382/172 |
| 2011/0249016 | A1* | 10/2011 | Zhang | G06T 11/001 345/589 |
| 2014/0184662 | A1* | 7/2014 | Kobiki | G06T 5/009 345/690 |
| 2015/0009192 | A1* | 1/2015 | Yang | G09G 3/3406 345/207 |
| 2015/0302789 | A1* | 10/2015 | Furihata | G09G 3/2007 345/694 |
| 2017/0316749 | A1* | 11/2017 | Kuwajima | G09G 3/3648 |
| 2022/0068176 | A1* | 3/2022 | Han | G09G 3/32 |
| 2023/0048619 | A1* | 2/2023 | Kim | G09G 3/32 |

* cited by examiner

DISPLAY DEVICE AND DRIVING METHOD THEREOF

CROSS-REFERENCE TO RELATED APPLICATION

The application claims priority to and the benefit of Korean Patent Application No. 10-2021-0107574 filed Aug. 13, 2021, which is hereby incorporated by reference.

BACKGROUND

Field

The present invention relates to a display device and a driving method thereof.

Discussion

With the development of information technology, display devices have become increasingly important, as they provide connection between users and information. In response to this, use of display devices such as a liquid crystal display device, an organic light emitting display device, and the like has been increasing.

A display device may not be able to display an image with a target luminance due to a hysteresis phenomenon. Various countermeasures for this are being researched.

SUMMARY

A technical problem to be solved is to provide a display device capable of solving an instantaneous afterimage issue while minimizing memory usage, and a driving method thereof.

A display device according to an embodiment of the present disclosure may include an afterimage compensator generating output grayscales by applying at least one of a first weight and a second weight to input grayscales when the input grayscales correspond to a still image; and pixels displaying an image based on the output grayscales. The afterimage compensator may apply the first weight having an initial value greater than 1 to the input grayscales of a first group, and converge the first weights to 1, and apply the second weight having an initial value less than 1 to the input grayscales of a second group, and converge the second weights to 1.

A representative value of the input grayscales of the first group may be smaller than a corresponding representative value of a previous frame, and a representative value of the input grayscales of the second group may be greater than the corresponding representative value of the previous frame.

As a difference between the representative value of the input grayscales of the first group and the corresponding representative value of the previous frame increases, the initial values of the first weights may increase, and as a difference between the representative value of the input grayscales of the second group and the corresponding representative value of the previous frame increases, the initial values of the second weights may decrease.

The afterimage compensator may include a look-up table in which the initial value of the first weight and the initial value of the second weight are recorded.

The afterimage compensator may further include a pixel group representative value calculator calculating pixel group representative values that are representative values in units of pixel groups with respect to the input grayscales.

The afterimage compensator may further include a counter providing a counted value by counting the number of pixel group representative values falling within a threshold range among the pixel group representative values.

The afterimage compensator may further include a still image detector determining whether a plurality of frames correspond to the still image based on input grayscales for the plurality of frames, and generating a still image detection signal when the plurality of frames correspond to the still image.

The afterimage compensator may further include a selector generating the output grayscales by applying at least one of the first weight and the second weight to the input grayscales when the still image detection signal is received, and generating the output grayscales to be the same as the input grayscales when the still image detection signal is not received.

The afterimage compensator may further include a line representative value calculator calculating line representative values that are representative values in units of pixel rows with respect to the pixel group representative values.

The afterimage compensator may include a memory outputting the line representative values of a previous frame and storing the line representative values of a current frame.

The afterimage compensator may include a weight calculator determining the input grayscales of the first group, the first weight, the input grayscales of the second group, and the second weight based on a difference between the line representative values of the current frame and the line representative values of the previous frame when the counted value is greater than a threshold value.

The weight calculator may determine the first weight and the second weight to be 1 when the counted value is less than the threshold value.

The afterimage compensator may include a weight calculator determining the input grayscales of the first group, the first weight, the input grayscales of the second group, and the second weight based on a difference between the line representative values of the current frame and the line representative values of the previous frame and the pixel group representative values when the counted value is greater than a threshold value.

The afterimage compensator may include a weight calculator determining the input grayscales of the first group, the first weights, the input grayscales of the second group, and the second weights based on a difference between the pixel group representative values and the line representative values of the previous frame when the counted value is greater than a threshold value.

The afterimage compensator may further include a frame representative value calculator calculating a frame representative value that is a representative value in units of frames with respect to the pixel group representative values.

The afterimage compensator may include a memory outputting the frame representative value of a previous frame and storing the frame representative value of a current frame.

The afterimage compensator may include a weight calculator determining the input grayscales of the first group, the first weights, the input grayscales of the second group, and the second weights based on a difference between the frame representative value of the current frame and the frame representative value of the previous frame and the pixel group representative values when the counted value is greater than a threshold value.

The afterimage compensator may include a weight calculator determining the input grayscales of the first group, the first weights the input grayscales of the second group, and the second weight based on a difference between the pixel group representative values and the frame representative value of the previous frame when the counted value is greater than the threshold value.

A driving method of a display device according to an embodiment of the present disclosure may include generating a still image detection signal when input grayscales correspond to a still image; generating output grayscales by applying at least one of a first weight and a second weight to the input grayscales when the still image detection signal is generated; and displaying an image based on the output grayscales. In the generating the output grayscales, the first weight having an initial value greater than 1 may be applied to the input grayscales of a first group and converged to 1, and the second weight having initial values less than 1 may be applied to the input grayscales of a second group and converged to 1.

A representative value of the input grayscales of the first group may be smaller than a corresponding representative value of a previous frame, and a representative value of the input grayscales of the second group may be greater than the corresponding representative value of the previous frame.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
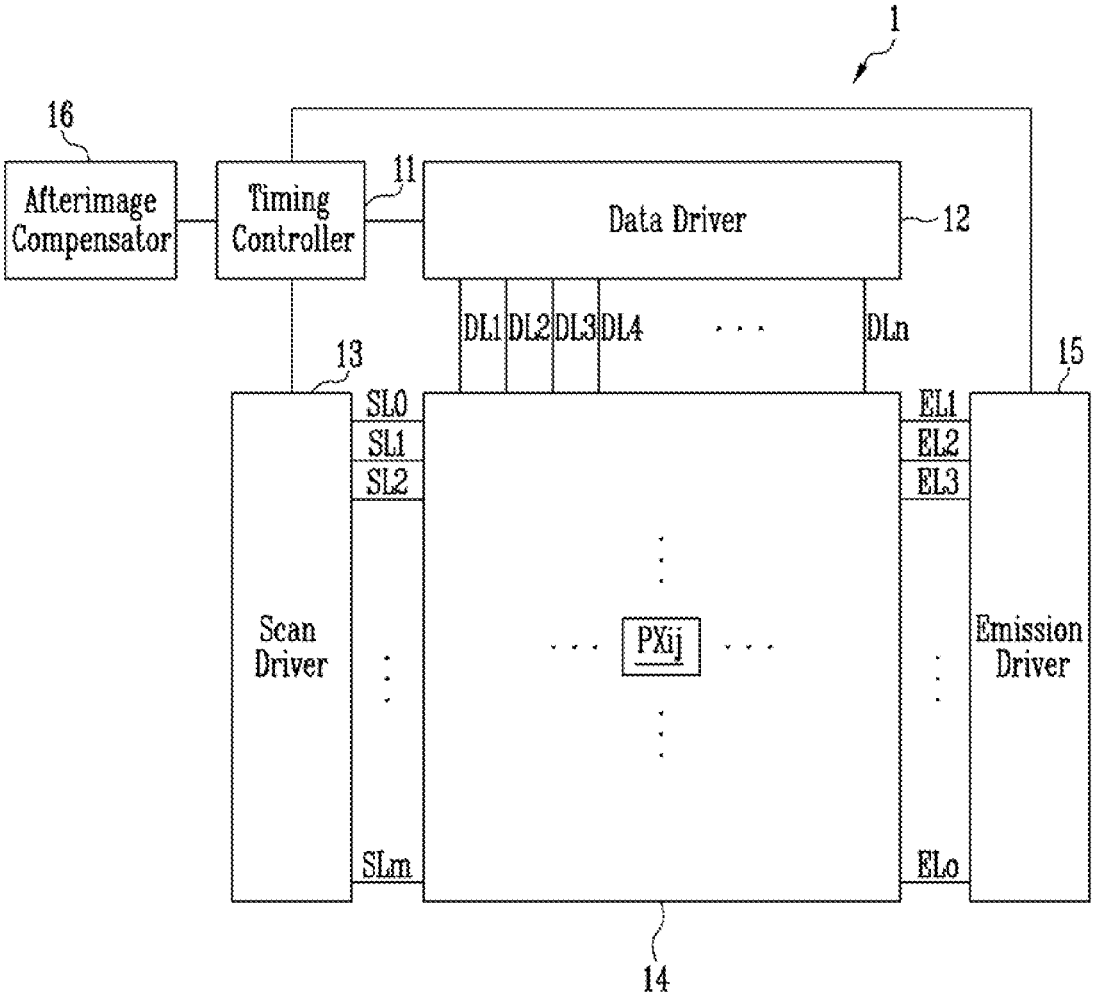
FIG. 1 is a diagram for explaining a display device according to an embodiment of the present invention.

Hereinafter, various embodiments of the present invention will be described in detail with reference to the accompanying drawings so that those of ordinary skill in the art may easily implement the present invention. The present invention may be embodied in various different forms and is not limited to the embodiments described herein.

In order to clearly describe the present invention, parts that are not related to the description are omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the present invention is not necessarily limited to those shown in the drawings. In the drawings, thicknesses may be exaggerated to clearly express the layers and regions.

In addition, in the description, the expression "is the same" may mean "substantially the same". That is, it may be alike enough to convince those of ordinary skill in the art to be the same. In other expressions, "substantially" may be omitted.

FIG. 1 is a diagram depicting a display device according to an embodiment of the present invention.

Referring to FIG. 1, a display device 1 may include a timing controller 11, a data driver 12, a scan driver 13, a pixel unit 14, an emission driver 15, and an afterimage compensator 16.

The timing controller 11 may receive input grayscales and timing signals for each frame from a processor. Here, the processor may correspond to at least one of a graphics processing unit (GPU), a central processing unit (CPU), and an application processor (AP). The timing signals may include a vertical synchronization signal, a horizontal synchronization signal, a data enable signal, and the like.

Each cycle of the vertical synchronization signal may correspond to each frame period. Each cycle of the horizontal synchronization signal may correspond to each horizontal period. The input grayscales may be supplied in units of horizontal lines in each horizontal period in response to a pulse of an enable level of the data enable signal. A horizontal line may mean pixels (for example, a pixel row) connected to the same scan line and emission line.

When the input grayscales correspond to a still image, the afterimage compensator 16 may generate output grayscales by applying weights to the input grayscales. The afterimage compensator 16 may receive the input grayscales from the timing controller 11 and provide the generated output grayscales to the timing controller 11. The afterimage compensator 16 and the timing controller 11 may be independent hardware or may be integrated hardware. Meanwhile, the afterimage compensator 16 may be implemented in software within the timing controller 11.

The timing controller 11 may provide the output grayscales and a data control signal to the data driver 12. Also, the timing controller 11 may provide a scan control signal to the scan driver 13 and provide an emission control signal to the emission driver 15.

The data driver 12 may generate data voltages (that is, data signals) to be provided to data lines DL1, DL2, DL3, DL4, . . . , and DLn using the output grayscales and the data control signal received from the timing controller 11, where n may be an integer greater than 0. The data control signal may vary according to a predefined interface between the data driver 12 and the timing controller 11.

The scan driver 13 may generate scan signals to be provided to scan lines SL0, SL1, SL2, . . . , and SLm using the scan control signal (for example, a clock signal, a scan start signal, and the like) received from the timing controller 11, where m may be an integer greater than 0. The scan driver 13 may sequentially supply the scan signals having a turn-on level pulse to the scan lines SL0 to SLm. The scan driver 13 may include scan stages configured in the form of a shift register. The scan driver 13 may generate the scan signals by sequentially transferring the scan start signal in the form of a turn-on level pulse to the next scan stage according to the control of the clock signal.

The emission driver 15 may generate emission signals to be provided to emission lines EL1, EL2, EL3, . . . , and ELo using the emission control signal (for example, a clock signal, an emission stop signal, and the like) received from the timing controller 11, where "o" may be an integer greater than 0. The emission driver 15 may sequentially supply the emission signals having a turn-off level pulse to the emission lines EL1 to ELo. The emission driver 15 may include emission stages configured in the form of a shift register. The emission driver 15 may generate the emission signals by sequentially transferring the emission stop signal in the form of a turn-off level pulse to the next emission stage according to the control of the clock signal.

The pixel unit 14 may include pixels. The pixels may display an image based on the output grayscales. Each pixel PXij may be connected to a corresponding data line, scan line, and emission line. For example, the pixels may include pixels emitting light of a first color, pixels emitting light of a second color, and pixels emitting light of a third color. The first color, the second color, and the third color may be different colors. For example, the first color may be one color among red, green, and blue, the second color may be one color other than the first color among red, green, and blue, and the third color may be other color other than the first color and the second color among red, green, and blue. Also, as the first to third colors, magenta, cyan, and yellow may be used instead of red, green, and blue.

Figure 2:
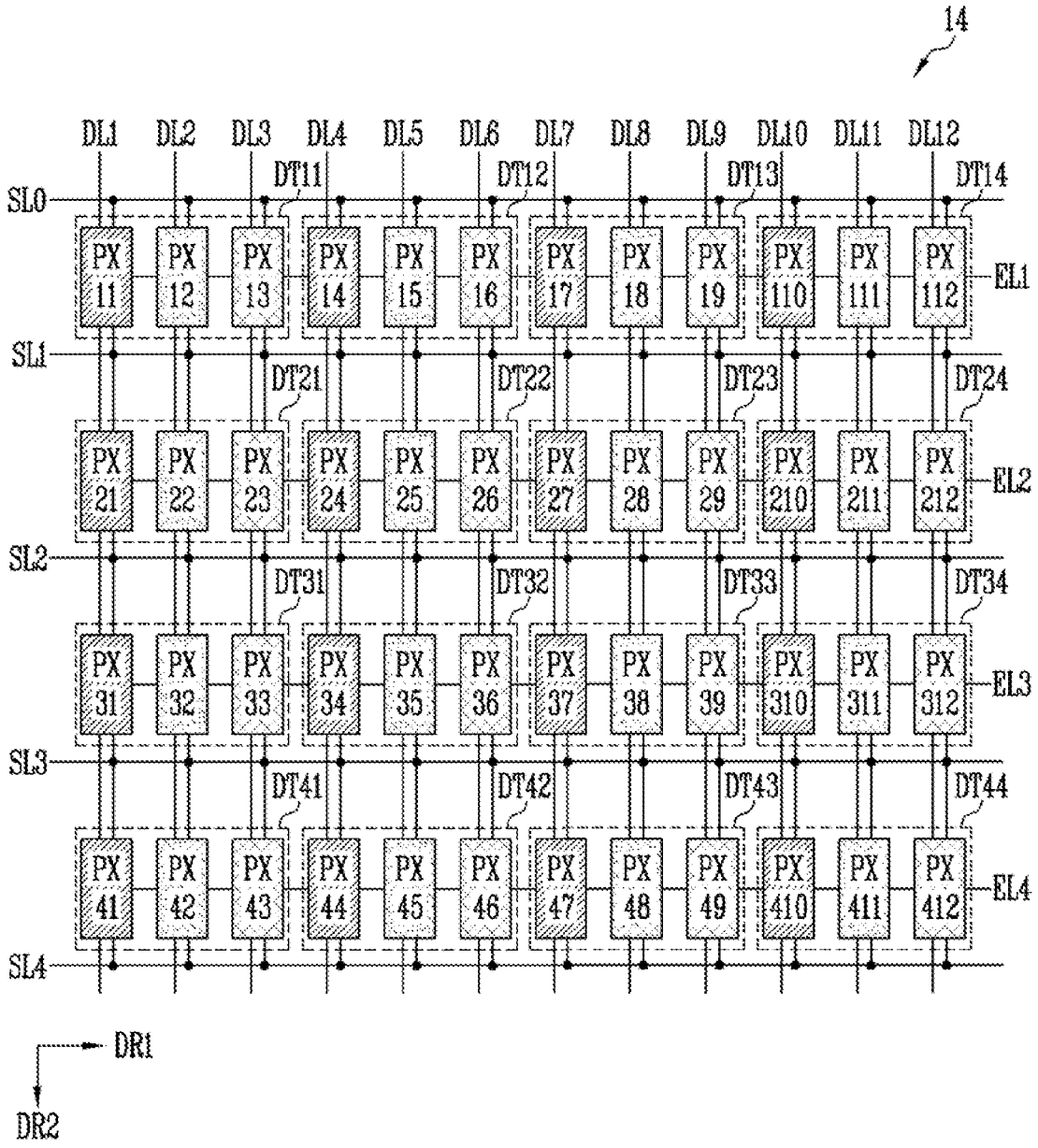
FIG. 2 is a diagram for explaining a pixel unit according to an embodiment of the present invention.

FIG. 2 is a diagram depicting a pixel unit according to an embodiment.

Referring to FIG. 2, the pixel unit 14 having an RGB stripe structure is shown as an example.

Each of pixel groups DT11, DT12, DT13, DT14, DT21, DT22, DT23, DT24, DT31, DT32, DT33, DT34, DT41, DT42, DT43, and DT44 may include a pixel of a first color, a pixel of a second color, and a pixel of a third color arranged in a first direction DR1. In this case, the first color, the second color, and the third color may be different from each other. For example, the first color may be red, the second color may be green, and the third color may be blue.

Figure 3:
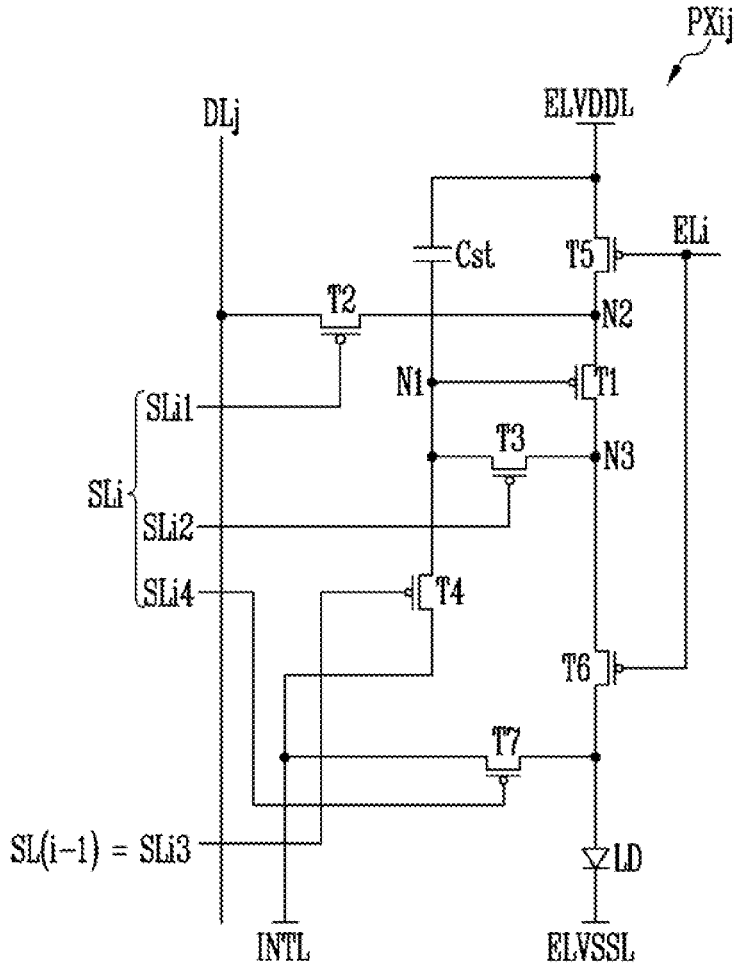
FIG. 3 is a diagram for explaining a pixel according to an embodiment of the present invention.

Here, the color of the pixel may mean a color when a light emitting element LD of FIG. 3 emits light. In addition, the position of the pixel will be described based on the position of the light emitting surface of the light emitting element LD.

Data lines DL1, DL2, DL3, DL4, DL5, DL6, DL7, DL8, DL9, DL10, DL11, and DL12 may be connected to pixels of a single color. For example, the data lines DL1, DL4, DL7, and DL10 may be connected to red pixels PX11, PX21, PX31, PX41, PX14, PX24, PX34, PX44, PX17, PX27, PX37, PX47, PX110, PX210, PX310, and PX410, respectively. The data lines DL2, DL5, DL8, and DL11 may be connected to green pixels PX12, PX22, PX32, PX42, PX15, PX25, PX35, PX45, PX18, PX28, PX38, PX48, PX111, PX211, PX311, and PX411, respectively. In addition, the data lines DL3, DL6, DL9, and DL12 may be connected to blue pixels PX13, PX23, PX33, PX43, PX16, PX26, PX36, PX46, PX19, PX29, PX39, PX49, PX112, PX212, PX312, and PX412, respectively.

A pixel row may mean pixels connected to the same scan line and emission line. For example, since the pixels PX11 to PX112 included in the pixel groups DT11, DT12, DT13, and DT14 are connected to the same scan lines SL0 and SL1 and emission line EL1, they can be said to belong to one pixel row. Since the pixels PX21 to PX212 included in the pixel groups DT21, DT22, DT23, and DT24 are connected to the same scan lines SL1 and SL2 and emission line EL2, they can be said to belong to one pixel row. The pixels PX31 to PX312 included in the pixel groups DT31, DT32, DT33, and DT34 are connected to the same scan lines SL2 and SL3 and emission line EL3, they can be said to belong to one pixel row. Since the pixels PX41 to PX412 included in the pixel groups DT41, DT42, DT43, and DT44 are connected to the same scan lines SL3 and SL4 and emission line EL4, they can be said to belong to one pixel row. In the embodiment of FIG. 2, each pixel row may extend in the first direction DR1, and pixel rows may be arranged in a second direction DR2.

FIG. 3 is a diagram for explaining a pixel according to an embodiment of the present disclosure.

Referring to FIG. 3, the pixel PXij may include transistors T1, T2, T3, T4, T5, T6, and T7, a storage capacitor Cst, and a light emitting element LD.

Hereinafter, a circuit composed of P-type transistors will be described as an example. However, a person skilled in the art will be able to design a circuit composed of N-type transistors by changing the polarity of a voltage applied to a gate terminal. Similarly, a person skilled in the art will be able to design a circuit composed of a combination of a P-type transistor and an N-type transistor. The P-type transistor may generally refer to a transistor in which the amount of current increases when a voltage difference between a gate electrode and a source electrode increases in a negative direction. The N-type transistor may generally refer to a transistor in which the amount of current increases when a voltage difference between a gate electrode and a source electrode increases in a positive direction. The transistor may be configured in various forms, such as a thin film transistor (TFT), a field effect transistor (FET), a bipolar junction transistor (BJT), and the like.

A first transistor T1 may have a gate electrode connected to a first node N1, a first electrode connected to a second node N2, and a second electrode connected to a third node N3. The first transistor T1 may be referred to as a driving transistor.

A second transistor T2 may have a gate electrode connected to a scan line SLi1, a first electrode connected to a data line DLj, and a second electrode connected to the second node N2. The second transistor T2 may be referred to as a scan transistor.

A third transistor T3 may have a gate electrode connected to a scan line SLi2, a first electrode connected to the first node N1, and a second electrode connected to the third node N3. The third transistor T3 may be referred to as a transistor connected in the form of a diode.

A fourth transistor T4 may have a gate electrode connected to a scan line SLi3, a first electrode connected to the first node N1, and a second electrode connected to an initialization line INTL. The fourth transistor T4 may be referred to as a gate initialization transistor.

A fifth transistor T5 may have a gate electrode connected to an i-th emission line ELi, a first electrode connected to a first power source line ELVDDL, and a second electrode connected to the second node N2. The fifth transistor T5 may be referred to as an emission transistor. In another embodiment, the gate electrode of the fifth transistor T5 may be connected to an emission line different from an emission line connected to a gate electrode of a sixth transistor T6.

The sixth transistor T6 may have the gate electrode connected to the i-th emission line ELi, a first electrode connected to the third node N3, and a second electrode connected to an anode of the light emitting element LD. The sixth transistor T6 may be referred to as an emission transistor. In another embodiment, the gate electrode of the sixth transistor T6 may be connected to the emission line different from the emission line connected to the gate electrode of the fifth transistor T5.

A seventh transistor T7 may have a gate electrode connected to a scan line SLi4, a first electrode connected to the initialization line INTL, and a second electrode connected to the anode of the light emitting element LD. The seventh transistor T7 may be referred to as a light emitting element initialization transistor.

A first electrode of the storage capacitor Cst may be connected to the first power source line ELVDDL, and a second electrode of the storage capacitor Cst may be connected to the first node N1.

The light emitting element LD may have the anode connected to the second electrode of the sixth transistor T6 and a cathode connected to a second power source line ELVSSL. The light emitting element LD may be a light emitting diode. The light emitting element LD may be composed of an organic light emitting element, an inorganic light emitting element, a quantum dot/well light emitting element, or the like. The light emitting element LD may emit light of any one of the first color, the second color, and the third color. In addition, in the present embodiment, each pixel includes only one light emitting element LD, but in another embodiment, each pixel may include a plurality of light emitting elements. In this case, the plurality of light emitting elements may be connected in series, in parallel, in series and parallel, or the like.

A first power source voltage may be applied to the first power source line ELVDDL, a second power source voltage may be applied to the second power source line ELVSSL, and an initialization voltage may be applied to the initialization line INTL. For example, the first power source voltage may be greater than the second power source voltage. For example, the initialization voltage may be equal to or greater than the second power source voltage. For example, the initialization voltage may correspond to a data voltage having the smallest magnitude among data voltages that can be provided. In another example, the magnitude of the initialization voltage may be smaller than magnitudes of the data voltages that can be provided.

Figure 4:
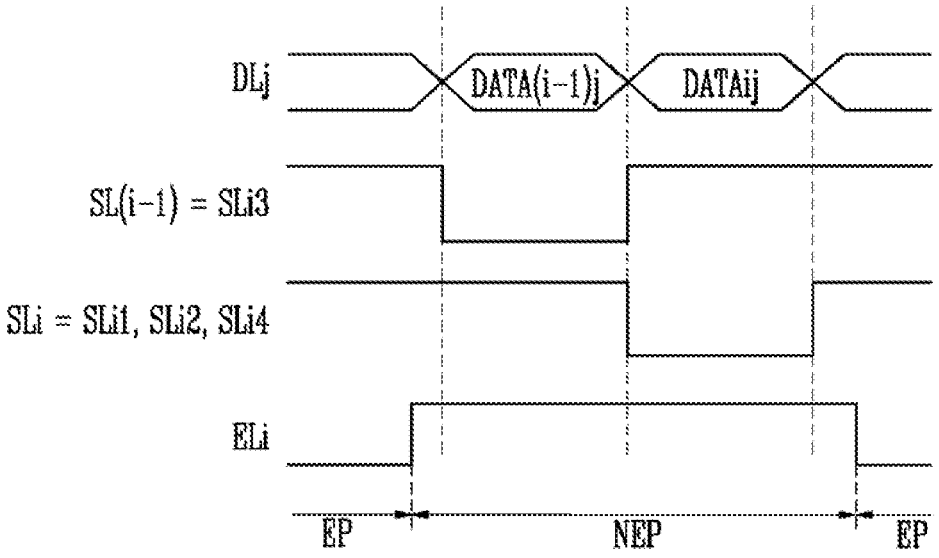
FIG. 4 is a diagram for explaining an example of a driving method of the pixel of FIG. 3.

FIG. 4 is a diagram depicting an example driving method of the pixel of FIG. 3.

Hereinafter, for convenience of description, it is assumed that the scan lines SLi1, SLi2, and SLi4 are i-th scan lines SLi, and the scan line SLi3 is an (i−1)th scan line SL(i−1). However, the connection relationship of the scan lines SLi1, SLi2, SLi3, and SLi4 may be changed according to embodiments. For example, the scan line SLi4 may be an (i−1)th scan line or an (i+1)th scan line.

First, an emission signal of a turn-off level (logic high level) may be applied to the i-th emission line ELi, a data voltage DATA(i−1)j for an (i−1)th pixel may be applied to the data line DLj, and a scan signal of a turn-on level (logic low level) may be applied to the scan line SLi3. High/low at the logic level may vary depending on whether the transistor is P-type or N-type.

In this case, since a scan signal of a turn-off level may be applied to the scan lines SLi1 and SLi2, the second transistor T2 may be in a turned-off state, and the data voltage DATA(i−1)j for the (i−1)th pixel may be prevented from being written into the pixel PXij.

At this time, since the fourth transistor T4 may be in a turned-on state, the first node N1 may be connected to the initialization line INTL, so that a voltage of the first node N1 may be initialized. Since the emission signal of the turn-off level may be applied to the emission line ELi, the transistors T5 and T6 may be in the turned-off state, and unnecessary light emitting by the light emitting element LD according to a process of applying the initialization voltage can be prevented.

Next, a data voltage DATAij for an i-th pixel PXij may be applied to the data line DLj, and the scan signal of the turn-on level may be applied to the scan lines SLi1 and SLi2. Accordingly, the transistors T2, T1, and T3 may be turned on, and the data line DLj and the first node N1 may be electrically connected. Accordingly, a compensation voltage obtained by subtracting a threshold voltage of the first transistor T1 from the data voltage DATAij may be applied to the second electrode of the storage capacitor Cst (that is, the first node N1), and the storage capacitor Cst may maintain a voltage corresponding to a difference between the first power source voltage and the compensation voltage. This period may be referred to as a threshold voltage compensation period or a data writing period.

In addition, when the scan line SLi4 is the i-th scan line, since the seventh transistor T7 may be in the turned-on state, the anode of the light emitting element LD may be connected to the initialization line INTL, and the light emitting element LD may be initialized with the amount of charge corresponding to a voltage difference between the initialization voltage and the second power source voltage.

Thereafter, as an emission signal of a turn-on level is applied to the i-th emission line ELi, the transistors T5 and T6 may be turned on. Accordingly, a driving current path connecting the first power source line ELVDDL, the fifth transistor T5, the first transistor T1, the sixth transistor T6, the light emitting element LD, and the second power source line ELVSSL may be formed.

The amount of driving current flowing through the first electrode and the second electrode of the first transistor T1 may be adjusted according to the voltage maintained in the storage capacitor Cst. The light emitting element LD may emit light with a luminance corresponding to the amount of driving current. The light emitting element LD may emit light until the emission signal of the turn-off level is applied to the emission line ELi.

When the emission signal is at the turn-on level, pixels receiving the corresponding emission signal may be in a display state. Accordingly, a period in which the emission signal is at the turn-on level may be referred to as an emission period EP (or emission allowable period). Also, when the emission signal is at the turn-off level, the pixels receiving the corresponding emission signal may be in a non-display state. Accordingly, a period in which the emission signal is at the turn-off level may be referred to as a non-emission period NEP (or emission disallowing period).

The non-emission period NEP described in FIG. 4 may be to prevent the pixel PXij from emitting light with an undesired luminance during an initialization period and a data writing period.

One or more non-emission periods NEP may be additionally provided while data written in the pixel PXij is maintained (for example, one frame period). This may be to effectively express a low grayscale by reducing the emission period EP of the pixel PXij, or to smoothly blur the motion of an image.

Figure 5:
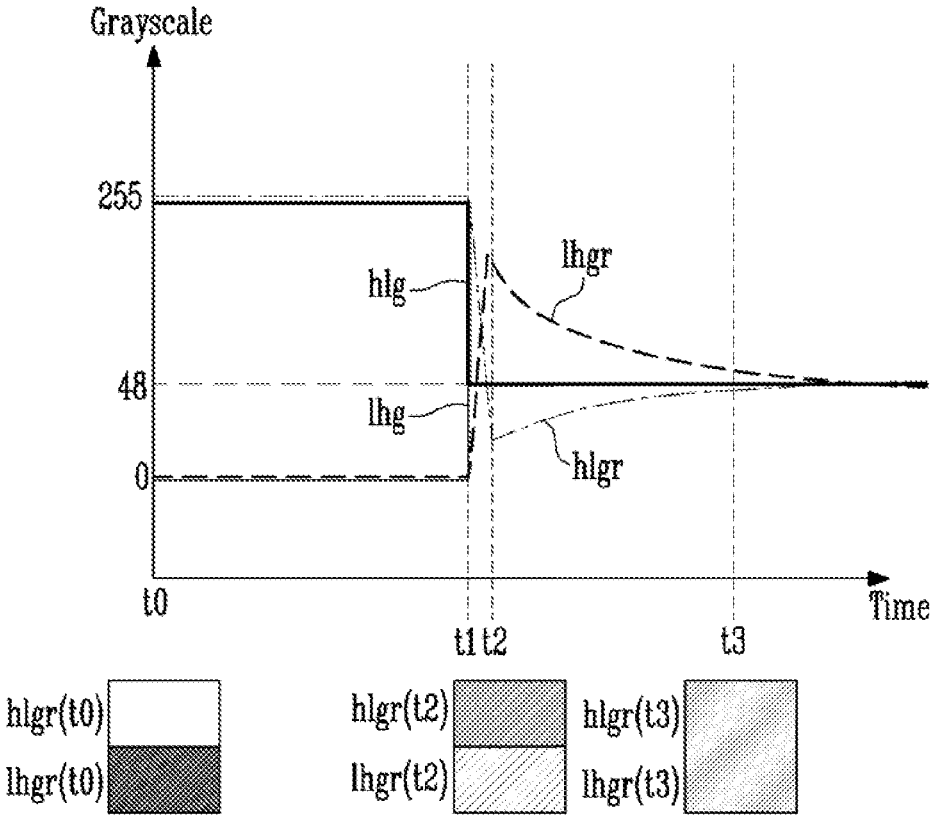
FIG. 5 is a diagram for explaining an instantaneous afterimage issue.

FIG. 5 is a diagram for explaining how an instantaneous afterimage occurs.

FIG. 5 depicts an example situation in which, at time to, a first pixel is in a state of receiving the data voltage corresponding to a white grayscale (for example, 255 grayscale) and a second pixel is in a state of receiving the data voltage corresponding to a black grayscale (for example, 0 grayscale). Then, at time t1, the first pixel is in a state of receiving the data voltage corresponding to a middle grayscale (for example, 48 grayscale), and the second pixel is in a state of receiving the data voltage corresponding to the same middle grayscale (for example, 48 grayscale). In an ideal world, the first pixel would emit light with a luminance corresponding to the graph hlg depicted in thick solid line, and the second pixel would emit light with a luminance corresponding to the graph Ihg depicted in thin solid line.

In reality, due to the hysteresis characteristic of the first transistor T1 and other factors, the drop in emission luminance of the first pixel may show a temporary overreaction in the negative direction as depicted by the graph hlgr to correspond to a grayscale lower than the middle grayscale at a timet t2. For the second pixel, the emission luminance may have temporarily overreacted in the positive direction, resulting in the graph Ihgr to correspond to a grayscale higher than the middle grayscale at the time t2. The hysteresis characteristic of the first transistor T1 may refer to a characteristic in which the amount of current with respect to the gate-source voltage when changing from a low grayscale to a high grayscale and the amount of current with respect to the gate-source voltage when changing from the high grayscale to the low grayscale are different from each other. The other factors may include an abrupt voltage change across the storage capacitor Cst. Accordingly, a user may momentarily visually recognize the afterimage during a period t1 to t3.

At a time point t3, the graph Ihgr may converge to the graph Ihg, and the graph hlgr may converge to the graph hlg, so that the user may not be able to visually recognize the afterimage. The period t1 to t3 may be defined as an instantaneous afterimage period. A start time point t1 and an end time point t2 of the instantaneous afterimage period may vary according to the definition of the afterimage (a degree of difference between the ideal luminance and the actual luminance).

Figure 6:
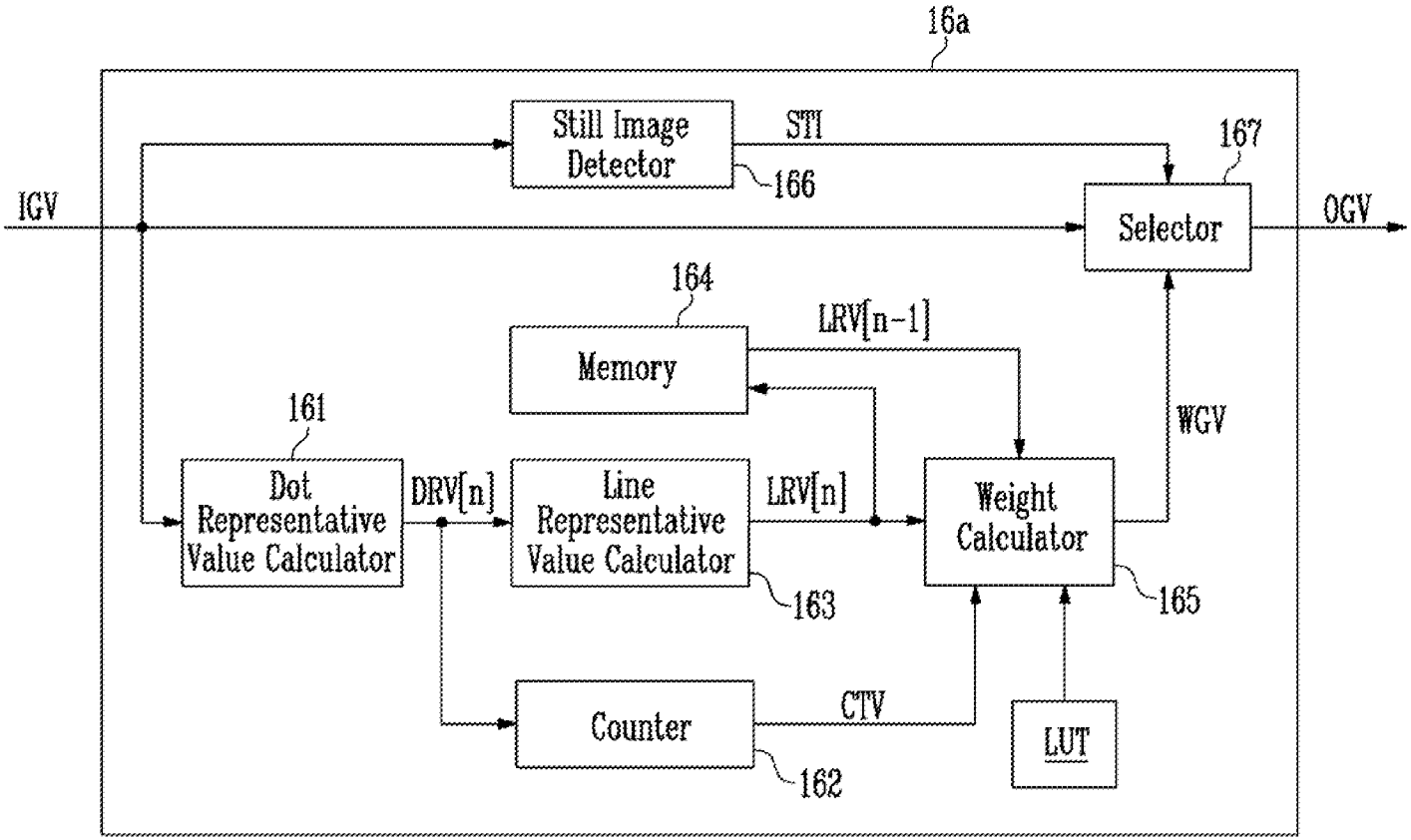
FIG. 6 is a diagram for explaining an afterimage compensator according to an embodiment of the present invention.

FIG. 6 is a diagram for explaining an afterimage compensator according to an embodiment of the present disclosure.

Referring to FIG. 6, an afterimage compensator 16*a* according to an embodiment may include a pixel group representative value calculator 161, a counter 162, a line representative value calculator 163, a memory 164, a weight calculator 165, a still image detector 166, a selector 167, and a look-up table LUT. The afterimage compensator of this disclosure is put together using known components available in the market, and detailed descriptions of circuitry in the parts are omitted.

When input grayscales IGV correspond to a still image, the afterimage compensator 16*a* may generate output grayscales OGV by applying weights WGV to the input grayscales IGV. The weights WGV may include first weight(s) and second weight(s).

The afterimage compensator 16*a* may designate the input grayscales IGV as a first group or a second group based on whether the grayscale went up or down between consecutive frames, apply the first weights to the input grayscales IGV of the first group, and apply the second weights to the input grayscales IGV of the second group. For example, when a representative value of the input grayscales IGV is smaller than a corresponding representative value of a previous frame, the afterimage compensator 16*a* may designate the input grayscales IGV as the first group. Referring to FIG. 5, the input grayscales of the first group may overreact in the negative direction—i.e., jump to a grayscale that is lower than the target grayscale—along the graph hlgr. Meanwhile, when the representative value of the input grayscales IGV is greater than the corresponding representative value of the previous frame, the afterimage compensator 16*a* may designate the input grayscales IGV as the second group. Referring to FIG. 5, the input grayscales of the second group may overreact along the graph Ihgr.

The afterimage compensator 16*a* may apply the first weights having initial values greater than 1 to the input grayscales IGV of the first group, and may converge the first weights to 1 as time elapses. That is, any overreaction in the negative direction may be compensated for by increasing the output grayscales OGV with respect to the input grayscales IGV. Meanwhile, the afterimage compensator 16*a* may apply the second weights having initial values less than 1 to the input grayscales IGV of the second group, and may converge the second weights to 1 as time elapses. That is, any overreaction in the positive direction may be compensated for by reducing the output grayscales OGV with respect to the input grayscales IGV.

The look-up table LUT may record the initial values of the first weights and the initial values of the second weights in advance. For example, the look-up table LUT may reduce memory usage by not recording values other than initial values of the first weights and the second weights. For example, the look-up table LUT may be written to the memory 164 or stored in another memory.

As a difference between the representative value of the input grayscales of the first group and the corresponding representative value of the previous frame increases, the initial values of the first weights may increase. That is, as the degree of overreaction in the negative direction increases, the degree of afterimage compensation may increase. Meanwhile, as a difference between the representative value of the input grayscales of the second group and the corresponding representative value of the previous frame increases, the initial values of the second weights may decrease. That is, as the degree of overreaction in the positive direction increases, the degree of afterimage compensation may increase.

Afterimage compensators 16*a*, 16*b*, 16*c*, 16*d*, and 16*e* shown in FIGS. 6, 11, 12, 13, and 14 may commonly include the above-described afterimage compensation process. Hereinafter, contents that have not been described and differences between embodiments will be mainly described.

Referring back to FIG. 6, the pixel group representative value calculator 161 may calculate pixel group representative values DRV[n], which are representative values in units of pixel groups for the input grayscales IGV. For example, the pixel group representative values DRV[n] may include at least one of an average value, a maximum value, and a minimum value of the input grayscales IGV of pixels of the corresponding pixel group. Here, n may indicate a frame number, and an n-th frame may indicate a current frame. An (n−1)th frame may indicate a previous frame. As previously described with reference to FIG. 2, each pixel group in the RGB stripe structure may include three pixels. Each of the pixel group representative values DRV[n] may be calculated using Equation 1 below.

$$DRV=(RV*RC+GV*GC+BV*BC)/100 \quad \text{[Equation 1]}$$

Here, DRV may be a pixel group representative value of one pixel group, RV may be a red grayscale value of a corresponding pixel group, RC may be a red weight, GV may be a green grayscale value of the corresponding pixel group, GC may be a green weight, BV may be a blue grayscale value of the corresponding pixel group, and BC may be a blue weight. For example, RV, GV, and BV may be grayscale values to which a gamma value (for example, 2.2) is applied. For example, RC+GC+BC may be 100. For example, RC may be set to 10, GC may be set to 85, and BC may be set to 5. A ratio between RC, GC, and BC may be determined differently according to a luminance contribution ratio in the display device 1.

The counter 162 may provide a counted value CTV by counting the number of pixel group representative values DRV[n] falling within a threshold range among the pixel group representative values DRV[n]. For example, when the entire grayscale range is greater than or equal to 0 grayscale and less than or equal to 255 grayscale, the threshold range may have a range of 40 grayscale or more to 48 grayscale or less. The threshold range may be determined as a range in which an instantaneous afterimage is most easily visually recognized according to the specification of the display device 1. For example, when the number of pixel groups constituting the pixel unit 14 is 1920*1080, the counted value CTV may have a range of 0 to 1920*1080.

The still image detector 166 may determine whether a plurality of frames correspond to a still image based on the input grayscales IGV for the plurality of frames, and may generate a still image detection signal STI when the plurality of frames correspond to the still image. For example, when the plurality of frames display the same image for a predetermined time or longer (for example, 10 seconds), the still image detector 166 may generate the still image detection signal STI. The same degree of the predetermined time and the plurality of frames may be determined differently according to the specification of the display device 1. As a still image detection algorithm, already known techniques may be used, and thus, further description thereof will not be made.

When the still image detection signal STI is received (that is, in the case of a still image), the selector 167 may generate the output grayscales OGV by applying (for example, multiplying) the weights WGV to the input grayscales IGV. Also, when the still image detection signal STI is not received (that is, in the case of a moving image), the selector 167 may generate the output grayscales OGV to be the same as the input grayscales IGV.

The line representative value calculator 163 may calculate line representative values LRV[n], which are representative values in units of pixel rows, with respect to the pixel group representative values DRV[n]. As described above, the pixel row may mean pixels (or pixel groups) connected to the same scan line and the same emission line. For example, the line representative values LRV[n] may include at least one of an average value, a maximum value, and a minimum value of the pixel group representative values DRV[n] of a corresponding pixel row. It is assumed that the line representative values LRV[n], which will be described later, are average values of the pixel group representative values DRV[n].

The memory 164 may output line representative values LRV[n−1] of the previous frame and store the line representative values LRV[n] of the current frame. Since the pixel group representative values DRV[n] of the previous frame or the current frame do not need to be stored in the memory 164, the cost of configuring the memory can be reduced.

The weight calculator 165 may determine the first weights and the second weights to be 1 when the counted value CTV is less than a threshold value. Accordingly, the input grayscales IGV and the output grayscales OGV may be the same.

When the counted value CTV is greater than the threshold value, the weight calculator 165 may determine the input grayscales of the first group, the first weights, the input grayscales of the second group, and the second weights based on a difference between the line representative values LRV[n] of the current frame and the line representative values LRV[n−1] of the previous frame. For example, when the number of pixel groups constituting the pixel unit 14 is 1920*1080 and the threshold value is set based on 85%, the threshold value may be set as 1920*1080*0.85=1,762,560. The threshold value may be adjusted according to the specification of the display device 1.

The weight calculator 165 may designate the input grayscales IGV as the first group or the second group, apply the first weight(s) to the input grayscales IGV of the first group, and apply the second weight(s) to the input grayscales IGV of the second group. For example, when a line representative value LRV[n] is smaller than a corresponding line representative value LRV[n−1] of the previous frame, the weight calculator 165 may designate the input grayscales IGV corresponding to the line representative value LRV[n] (that is, of the corresponding pixel row) as the first group. Referring to FIG. 5, the input grayscales of the first group may overreact in the negative direction along the graph hlgr. Meanwhile, when the line representative value LRV[n] is greater than the corresponding line representative value LRV[n−1] of the previous frame, the weight calculator 165 may designate the input grayscales IGV corresponding to the line representative value LRV[n] (that is, of the corresponding pixel row) as the second group. Referring to FIG. 5, the input grayscales of the second group may overreact in the positive direction along the graph lhgr.

The weight calculator 165 may apply the first weights having initial values greater than 1 to the input grayscales IGV of the first group, and may converge the first weights to 1 as time elapses. That is, overreaction in the negative direction may be compensated for by increasing the output grayscales OGV with respect to the input grayscales IGV. Meanwhile, the weight calculator 165 may apply the second weights having initial values less than 1 to the input grayscales of the second group, and may converge the second weights to 1 as time elapses. That is, overreaction in the positive direction may be compensated by reducing the output grayscales OGV with respect to the input grayscales IGV. As described above, the initial values of the first and second weights may be recorded in advance in the look-up table LUT.

Figure 7:
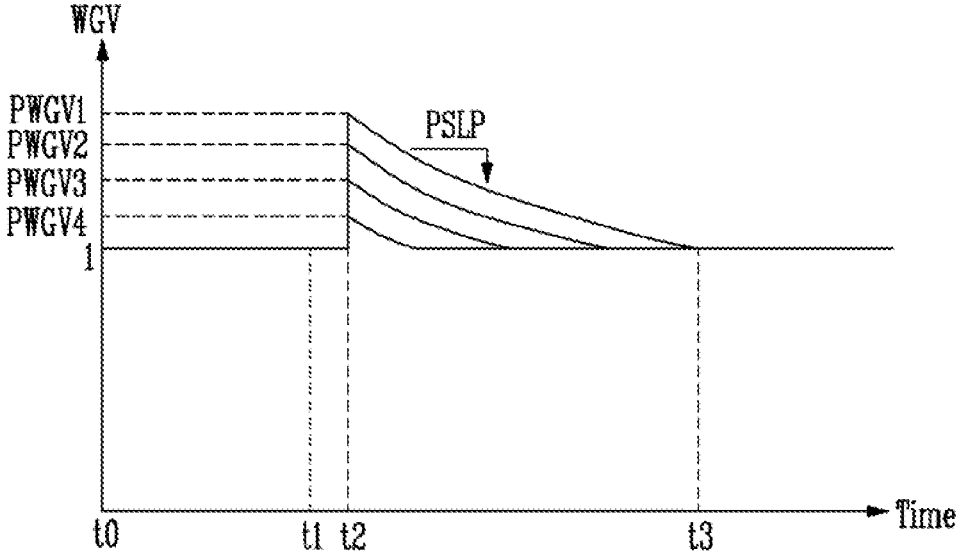
FIGS. 7 and 8 are diagrams for explaining first weights according to an embodiment of the present invention.
Figure 8:
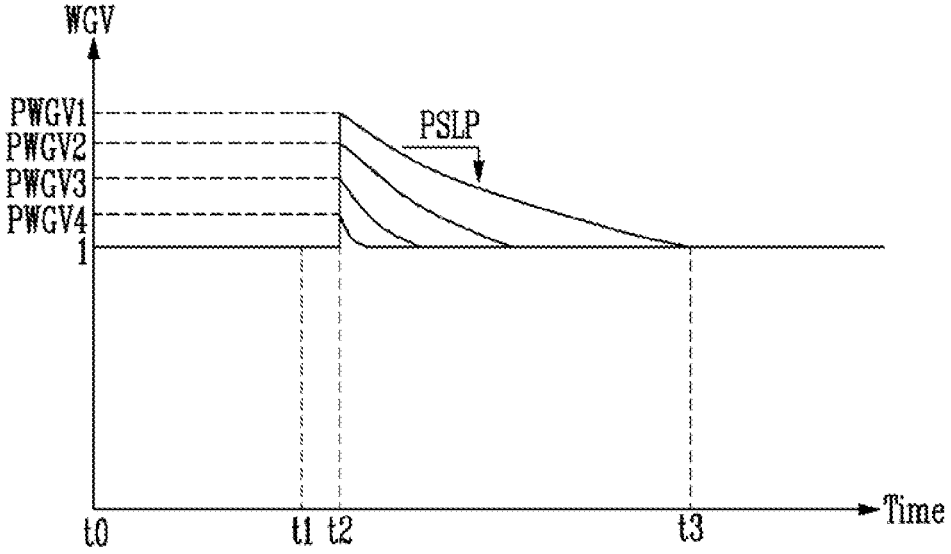

FIGS. 7 and 8 are diagrams depicting first weights according to an embodiment of the disclosure.

Referring to FIGS. 7 and 8, as the difference between the representative value of the input grayscales IGV of the first group (for example, the line representative value LRV[n]) and the corresponding representative value of the previous frame (for example, the line representative value LRV[n−1]) increases, initial values PWGV1, PWGV2, PWGV3, and PWGV4 of the first weights may increase. That is, as the degree of overreaction in the negative direction is expected to increase, the degree of afterimage compensation may increase.

In an embodiment, among the line representative values LRV[n], when a difference between the maximum value and the average value is large, or when a difference between the minimum value and the average value is large, the weight calculator 165 may reduce the degree of afterimage compensation. This is because, when a deviation of the pixel group representative values DRV[n] is large, a deviation in the afterimage compensation also increases, so that inappropriate luminance may be exhibited.

As described above, the look-up table LUT may reduce memory usage by not recording values other than the initial values of the first weights. Accordingly, the weight calculator 165 may converge the first weights to 1 as time elapses. That is, the weight calculator 165 may weaken the effect of afterimage compensation as time passes. In the embodiment of FIG. 7, the decreasing slope PSLP may be equally applied to the initial values PWGV1, PWGV2, PWGV3, and PWGV4 of all the first weights. The decreasing slope PSLP may mean a decrease amount of a weight WGV per time.

However, in the embodiment of FIG. 8, as the initial values PWGV1, PWGV2, PWGV3, and PWGV4 of the first weights decrease, the decreasing slope PSLP may be set to increase. For example, the decreasing slope PSLP may be set to the smallest for the largest initial value PWGV1, and the decreasing slope PSLP may be set to the largest for the smallest initial value PWGV4. This is because, compared to the former, a change in luminance of the latter is not easily visually recognized by the user. Accordingly, inaccurate luminance due to the afterimage compensation may be quickly restored.

Figure 9:
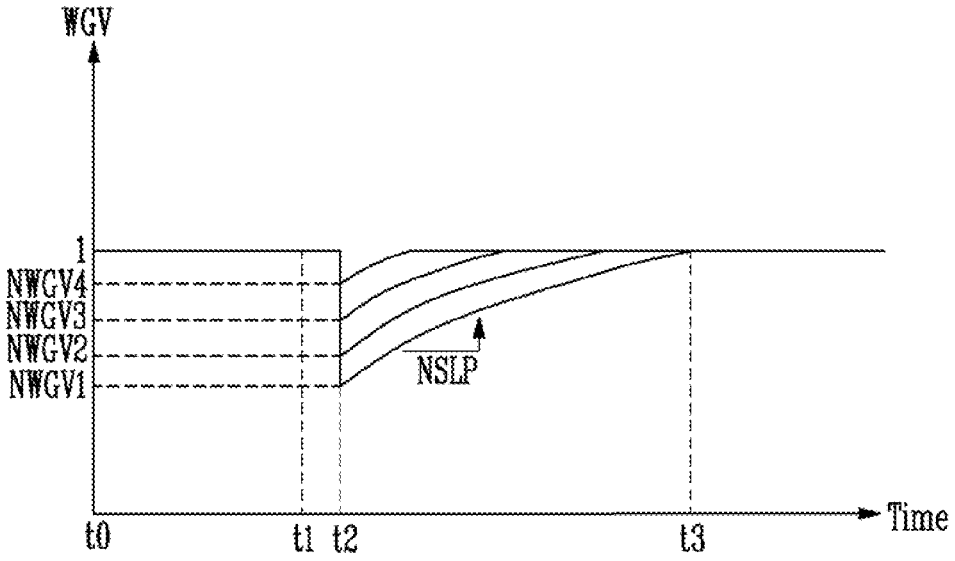
FIGS. 9 and 10 are diagrams for explaining second weights according to an embodiment of the present invention.
Figure 10:
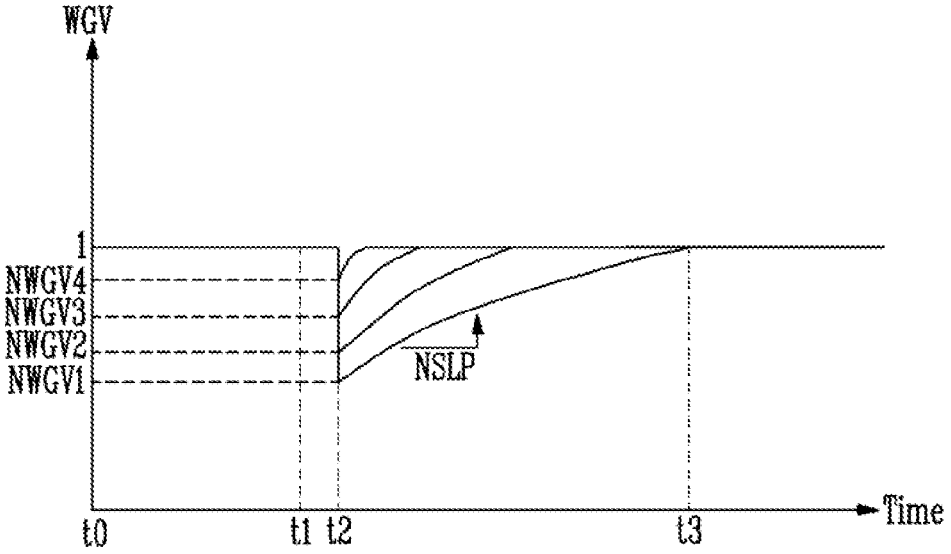

FIGS. 9 and 10 are diagrams for explaining second weights according to an embodiment of the present disclosure.

Referring to FIGS. 9 and 10, as the difference between the representative value of the input grayscales IGV of the second group (for example, the line representative value LRV[n]) and the corresponding representative value of the previous frame (for example, the line representative value LRV[n−1]) increases, initial values NWGV1, NWGV2, NWGV3, and NWGV4 of the second weights may decrease. That is, as the degree of overreaction in the positive direction is expected to increase, the degree of afterimage compensation may increase.

In an embodiment, among the line representative values LRV[n], when the difference between the maximum value and the average value is large, or when the difference between the minimum value and the average value is large, the weight calculator 165 may reduce the degree of afterimage compensation. This is because, when the deviation of the pixel group representative values DRV[n] is large, the deviation in the afterimage compensation also increases, so that the inappropriate luminance may be exhibited.

As described above, the look-up table LUT may reduce memory usage by not recording values other than the initial values of the second weights. Accordingly, the weight calculator 165 may converge the second weights to 1 as time elapses. That is, the weight calculator 165 may weaken the degree of afterimage compensation as time elapses. In the embodiment of FIG. 9, the increasing slope NSLP may be equally applied to the initial values NWGV1, NWGV2, NWGV3, and NWGV4 of all the second weights. The increasing slope NSLP may mean an increase in the amount of the weight WGV per time.

However, in the embodiment of FIG. 10, as the initial values NWGV1, NWGV2, NWGV3, and NWGV4 of the second weights increase, the increasing slope NSLP may be set to increase. For example, the increasing slope NSLP may be set to the largest for the largest initial value NWGV4, and the increasing slope NSLP may be set to the largest for the smallest initial value NWGV1. This is because, compared to the former, a change in luminance of the latter is not easily visually recognized by the user. Accordingly, inaccurate luminance due to the afterimage compensation may be quickly restored.

FIGS. 11 to 14 are diagrams for explaining afterimage compensators according to other embodiments of the disclosure.

Figure 11:
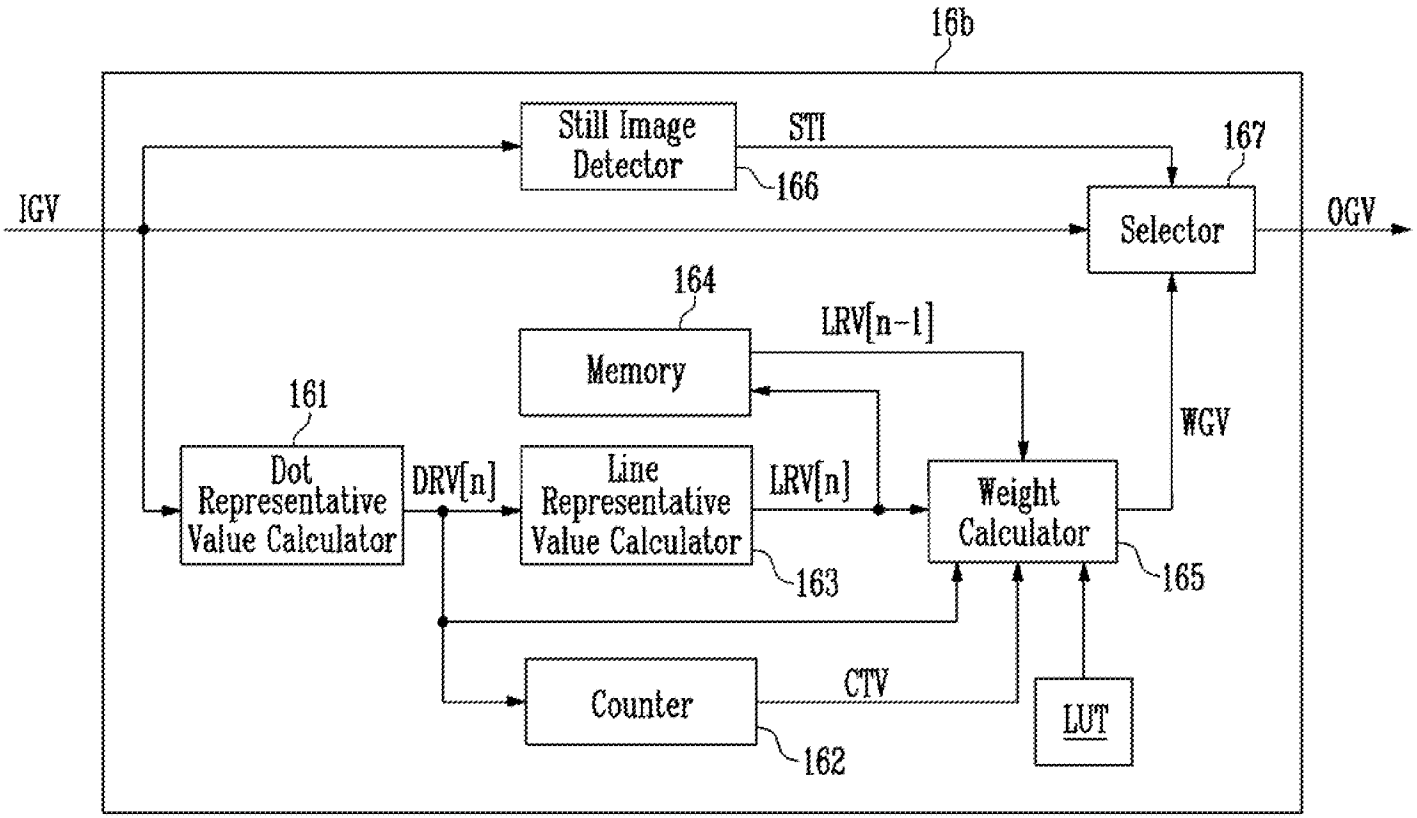
FIGS. 11 to 14 are diagrams for explaining afterimage compensators according to other embodiments of the present invention.

The afterimage compensator **16*b* of FIG. 11 may be different from the afterimage compensator 16*a* in that the weight calculator 165 further receives the pixel group representative values DRV[n]. Hereinafter, a difference between the afterimage compensator 16*b* and the afterimage compensator 16*a* will be mainly described, and descriptions of common contents of the afterimage compensator 16*b* and the afterimage compensator 16*a*** will be omitted.

When the counted value CTV is greater than the threshold value, the weight calculator 165 may determine the input grayscales of the first group, the first weights, the input grayscales of the second group, and the second weights based on the difference between the line representative values LRV[n] of the current frame and the line representative values LRV[n−1] of the previous frame and the pixel group representative values DRV[n].

For example, the weight calculator 165 may designate the input grayscales IGV as the first group or the second group by comparing the pixel group representative values DRV[n] with the line representative values LRV[n−1] of the previous frame. For example, the weight calculator 165 may designate the input grayscales IGV corresponding to the pixel group representative values DRV[n] that are smaller than the line representative values LRV[n−1] of the previous frame as the first group. Meanwhile, the weight calculator 165 may designate the input grayscales IGV corresponding to the pixel group representative values DRV[n] that are greater than the line representative values LRV[n−1] of the previous frame as the second group.

For example, the weight calculator 165 may determine the sizes of the initial values of the weights WGV based on the difference between the line representative values LRV[n] of the current frame and the line representative values LRV[n−1] of the previous frame. In this case, the size of the weight WGV determined in each pixel row may be commonly applied to the first group and the second group.

Accordingly, the afterimage compensator **16*b* according to the present embodiment may more accurately designate the first group and the second group without adding a memory cost compared to the afterimage compensator 16*a***, so that the accuracy of the afterimage compensation can be improved.

Figure 12:
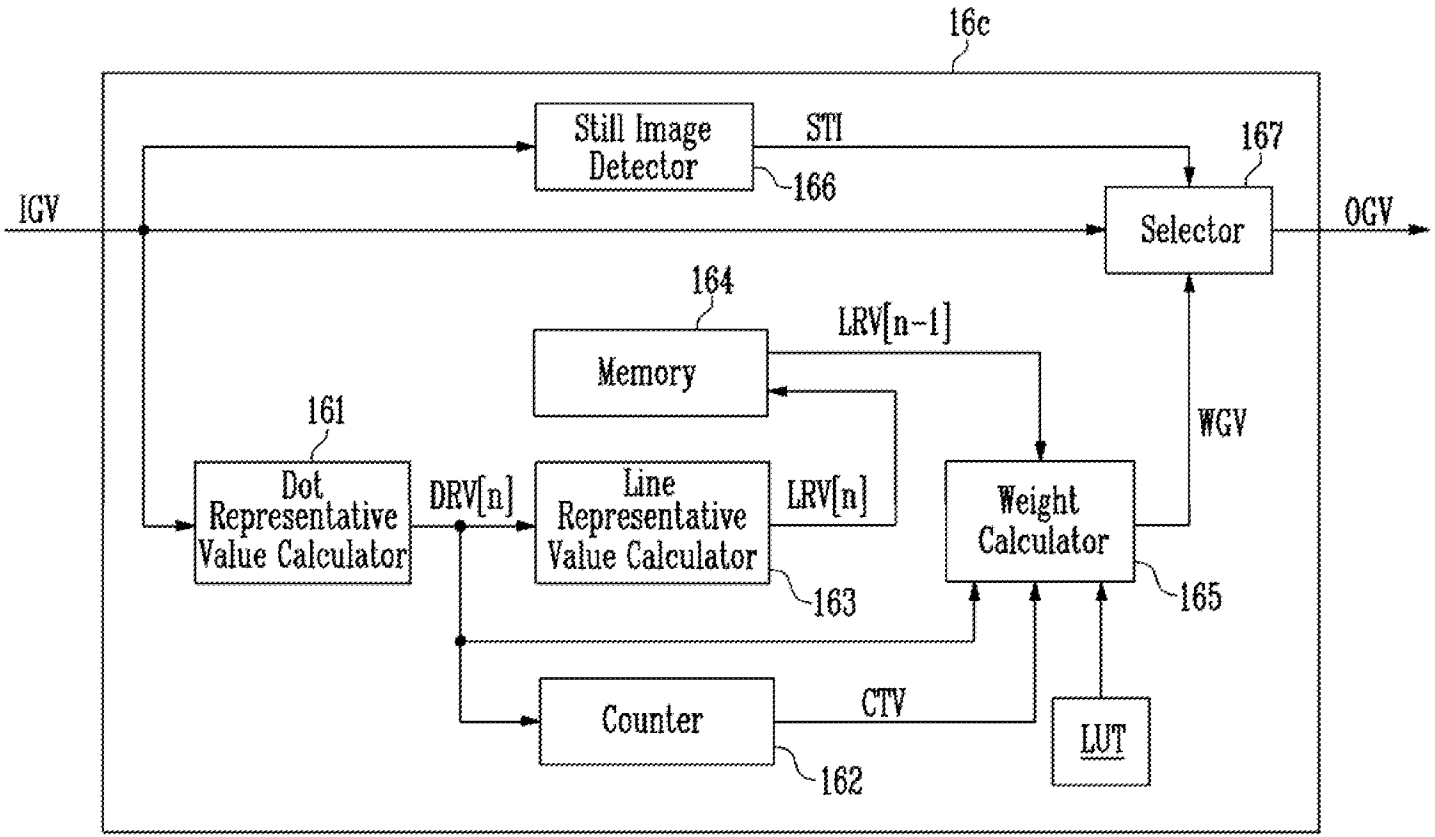

The afterimage compensator **16*c* of FIG. 12 may be different from the afterimage compensator 16*b* in that the weight calculator 165 does not receive the line representative values LRV[n] of the current frame. Hereinafter, a difference between the afterimage compensator 16*c* and the afterimage compensator 16*b* will be mainly described, and descriptions of common contents of the afterimage compensator 16*c* and the afterimage compensator 16*b*** will be omitted.

When the counted value CTV is greater than the threshold value, the weight calculator 165 may determine the input grayscales of the first group, the first weights, the input grayscales of the second group, and the second weights based on a difference between the pixel group representative values DRV[n] and the line representative values LRV[n−1] of the previous frame.

For example, the weight calculator 165 may designate the input grayscales IGV as the first group or the second group by comparing the pixel group representative values DRV[n] with the line representative values LRV[n−1] of the previous frame. Also, the weight calculator 165 may determine the sizes of the initial values of the weights WGV based on the difference between the pixel group representative values DRV[n] and the line representative values LRV[n−1] of the previous frame.

According to the present embodiment, the afterimage compensator 16*c* may more accurately designate the sizes of the initial values of the weights WGV without adding a memory cost compared to the afterimage compensator 16*b*, so that the accuracy of the afterimage compensation can be improved. However, the calculation cost of the afterimage compensator 16*c* may be higher than that of the afterimage compensator 16*b*.

Figure 13:
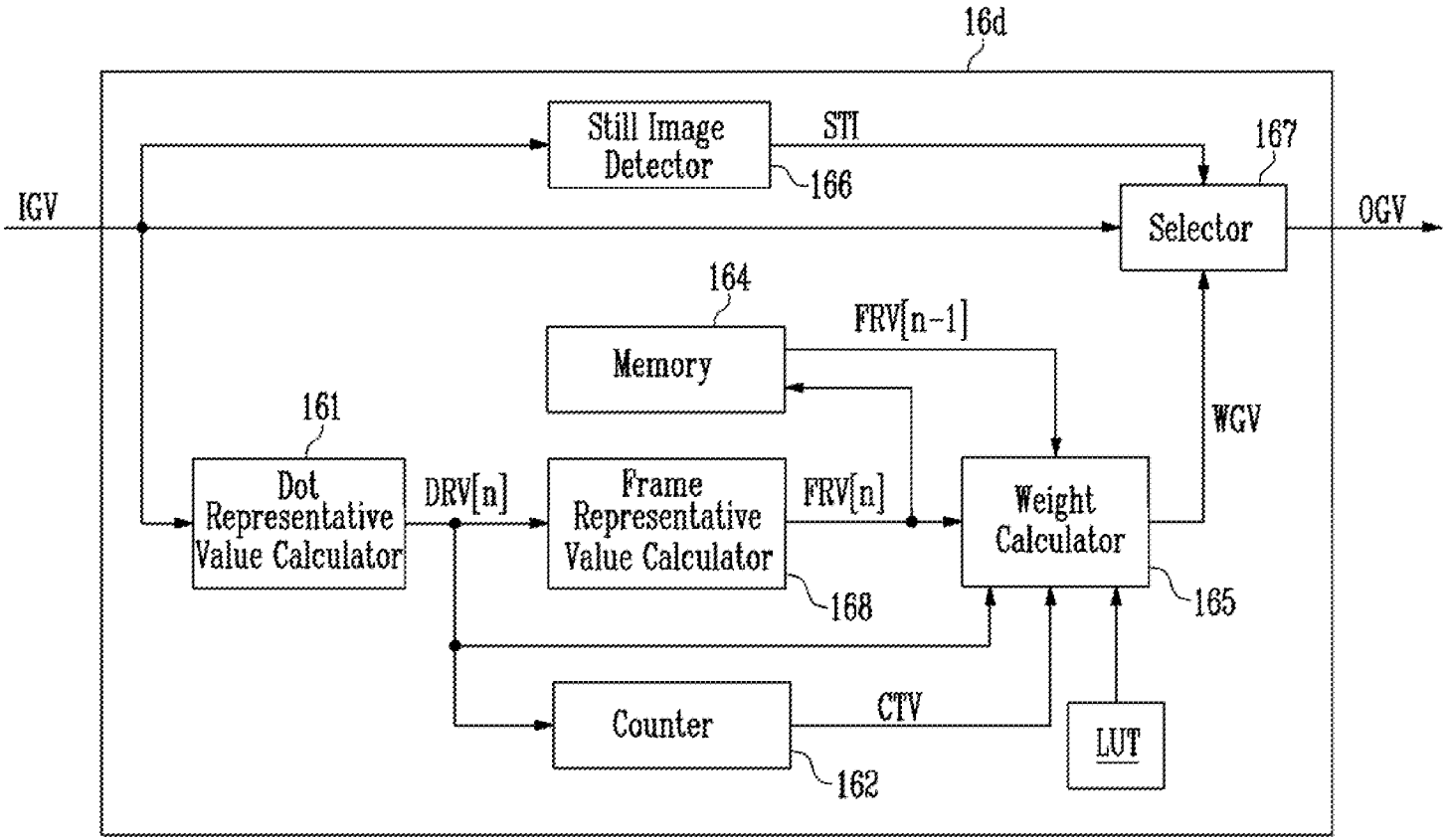

Referring to FIG. 13, the afterimage compensator 16*d* does not include the line representative value calculator 163, and may include a frame representative value calculator 168.

The frame representative value calculator 168 may calculate a frame representative value FRV[n] that is a representative value in units of frames with respect to the pixel group representative values DRV[n]. For example, the frame representative value FRV[n] may include at least one of an average value, a maximum value, and a minimum value of the pixel group representative values DRV[n] of a corresponding frame. It is assumed that the frame representative value FRV[n], which will be described later, is the average value of the pixel group representative values DRV[n].

The memory 164 may output a frame representative value FRV[n−1] of the previous frame and store the frame representative value FRV[n] of the current frame. According to the present embodiment, since the size of the frame representative value FRV[n] is smaller than the size of the line representative values LRV[n], the cost of configuring the memory can be reduced compared to the afterimage compensators 16*a*, 16*b*, and 16*c*.

When the counted value CTV is greater than the threshold value, the weight calculator 165 may determine the input grayscales of the first group, the first weights, the input grayscales of the second group, and the second weights based on the difference between the frame representative value FRV[n] of the current frame and the frame representative value FRV[n−1] of the previous frame and the pixel group representative values DRV[n].

For example, the weight calculator 165 may designate the input grayscales IGV as the first group or the second group by comparing the pixel group representative values DRV[n] with the frame representative value FRV[n−1] of the previous frame. For example, the weight calculator 165 may designate the input grayscales IGV corresponding the pixel group representative values DRV[n] that are smaller than the frame representative value FRV[n−1] of the previous frame as the first group. Meanwhile, the weight calculator 165 may designate the input grayscales IGV corresponding to the pixel group representative values DRV[n] that are larger than the frame representative value FRV[n−1] of the previous frame as the second group.

For example, the weight calculator 165 may determine the sizes of the initial values of the weights WGV based on the difference between the frame representative values FRV[n] of the current frame and the frame representative values FRV[n−1] of the previous frame. In this case, the size of the weight WGV determined in each pixel row may be commonly applied to the first group and the second group.

Accordingly, the afterimage compensator 16*d* according to the present embodiment may reduce a memory cost and may more accurately designate the first group and the second group compared to the afterimage compensator 16*a*, so that the accuracy of the afterimage compensation can be improved.

Figure 14:
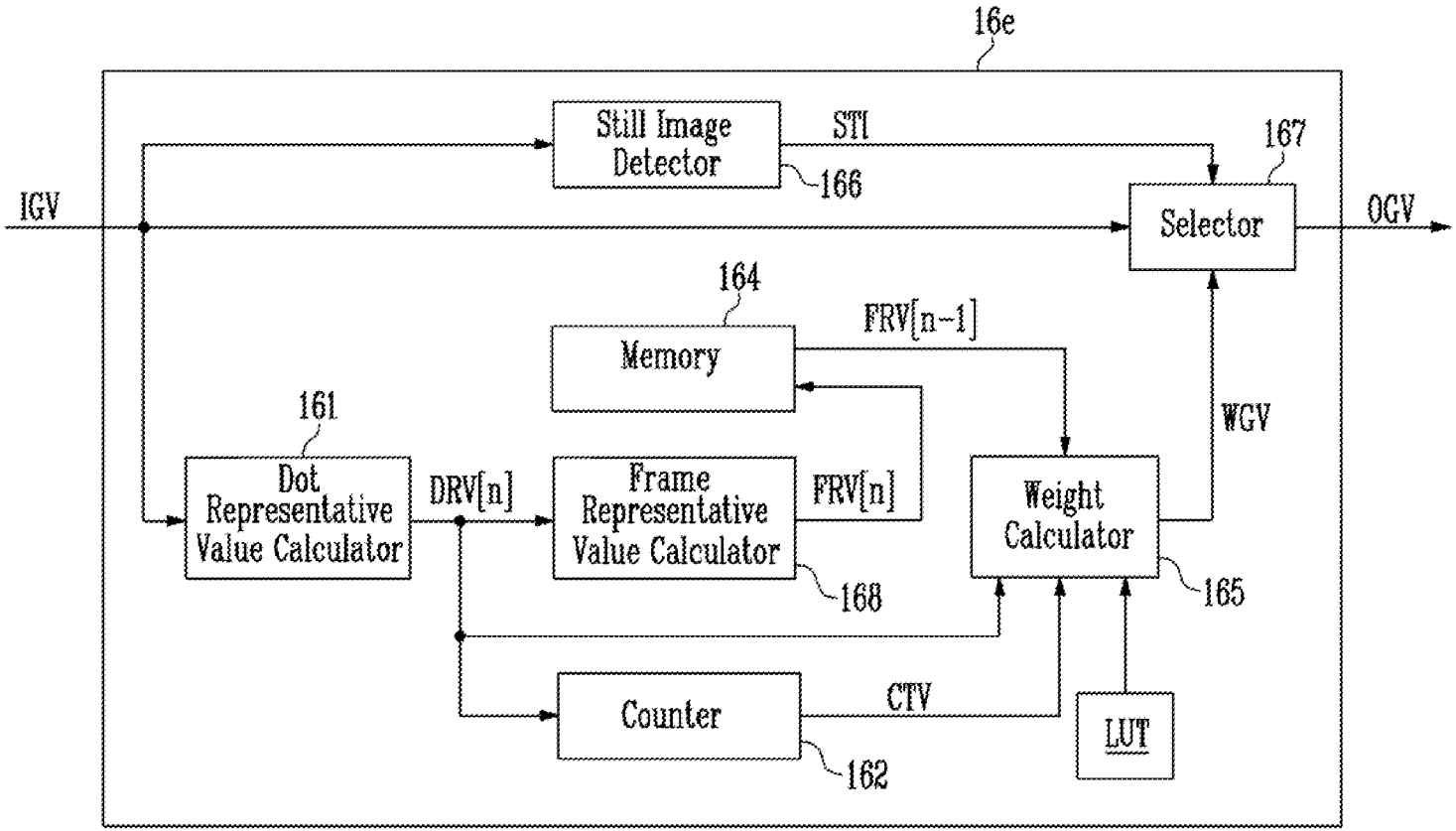

The afterimage compensator 16*e* of FIG. 14 may be different from the afterimage compensator 16*d* in that the weight calculator 165 does not receive the frame representative value FRV[n] of the current frame. Hereinafter, a difference between the afterimage compensator 16*e* and the afterimage compensator 16*d* will be mainly described, and descriptions of common contents of the afterimage compensator 16*e* and the afterimage compensator 16*d* will be omitted.

When the counted value CTV is greater than the threshold value, the weight calculator 165 may determine the input grayscales of the first group, the first weights, the input grayscales of the second group, and the second weights based on the difference between the pixel group representative values DRV[n] and the frame representative value FRV[n−1] of the previous frame.

For example, the weight calculator 165 may designate the input grayscales IGV as the first group or the second group by comparing the pixel group representative values DRV[n] with the frame representative value FRV[n−1] of the previous frame. Also, the weight calculator 165 may determine the sizes of the initial values of the weights WGV based on the difference between the pixel group representative values DRV[n] and the frame representative value FRV[n−1] of the previous frame.

According to the present embodiment, the afterimage compensator 16*e* may more accurately designate the sizes of the initial values of the weights WGV without adding a memory cost compared to the afterimage compensator 16*d*, so that the accuracy of the afterimage compensation can be improved. However, the calculation cost of the afterimage compensator 16*e* may be increased compared to the afterimage compensator 16*d*.

The display device and the driving method thereof according to the disclosure may solve an instantaneous afterimage issue while minimizing memory usage.

The drawings referred to heretofore and the detailed description of the concepts described above are merely illustrative of the disclosure. It is to be understood that the embodiments are disclosed for illustrative purposes only and are not intended to limit the meaning or scope of the disclosure as set forth in the claims. Therefore, those skilled in the art will appreciate that various modifications and equivalent embodiments are possible without departing from the scope of the disclosure. Accordingly, the true technical protection scope of the disclosure should be determined by the technical idea of the appended claims.

What is claimed is:

1. A display device comprising:

an afterimage compensator generating output grayscales by applying at least one of a first weight and a second weight to input grayscales when the input grayscales correspond to a still image; and pixels displaying an image based on the output grayscales, wherein the afterimage compensator applies the first weight having an initial value greater than 1 to the input grayscales designated as a first group, and converges the first weight to 1, and wherein the afterimage compensator applies the second weight having an initial value less than 1 to the input grayscales designated as a second group, and converges the second weight to 1.

2. The display device of claim 1, wherein a representative value of the input grayscales designated as the first group is smaller than a corresponding representative value of a previous frame, and wherein a representative value of the input grayscales designated as the second group is greater than the corresponding representative value of the previous frame.

3. The display device of claim 2, wherein as a difference between the representative value of the input grayscales designated as the first group and the corresponding representative value of the previous frame increases, the initial value of the first weight increases, and wherein as a difference between the representative value of the input grayscales designated as the second group and the corresponding representative value of the previous frame increases, the initial value of the second weight decreases.

4. The display device of claim 1, wherein the afterimage compensator includes:

a look-up table in which the initial value of the first weight and the initial value of the second weight are recorded.

5. The display device of claim 4, wherein the afterimage compensator further includes:

a pixel group representative value calculator calculating pixel group representative values that are representative values in units of pixel groups with respect to the input grayscales.

6. The display device of claim 5, wherein the afterimage compensator further includes:

a counter providing a counted value by counting the number of pixel group representative values falling within a threshold range among the pixel group representative values.

7. The display device of claim 6, wherein the afterimage compensator further includes:

a still image detector determining whether a plurality of frames correspond to the still image based on input grayscales for the plurality of frames, and generating a still image detection signal when the plurality of frames correspond to the still image.

8. The display device of claim 7, wherein the afterimage compensator further includes:

a selector generating the output grayscales by applying at least one of the first weight and the second weight to the input grayscales when the still image detection signal is received, and generating the output grayscales to be the same as the input grayscales when the still image detection signal is not received.

9. The display device of claim 8, wherein the afterimage compensator further includes:

a line representative value calculator calculating line representative values that are representative values in units of pixel rows with respect to the pixel group representative values.

10. The display device of claim 9, wherein the afterimage compensator includes:

a memory outputting the line representative values of a previous frame and storing the line representative values of a current frame.

11. The display device of claim 10, wherein the afterimage compensator includes:

a weight calculator determining the input grayscales designated as the first group, the first weight, the input grayscales designated as the second group, and the second weight based on a difference between the line representative values of the current frame and the line representative values of the previous frame when the counted value is greater than a threshold value.

12. The display device of claim 11, wherein the weight calculator determines the first weight and the second weight to be 1 when the counted value is less than the threshold value.

13. The display device of claim 10, wherein the afterimage compensator includes:

a weight calculator determining the input grayscales designated as the first group, the first weight, the input grayscales designated as the second group, and the second weight based on a difference between the line representative values of the current frame and the line representative values of the previous frame and the pixel group representative values when the counted value is greater than a threshold value.

14. The display device of claim 10, wherein the afterimage compensator includes:

a weight calculator determining the input grayscales designated as the first group, the first weight, the input grayscales designated as the second group, and the second weight based on a difference between the pixel group representative values and the line representative values of the previous frame when the counted value is greater than a threshold value.

15. The display device of claim 8, wherein the afterimage compensator further includes:

a frame representative value calculator calculating a frame representative value that is a representative value in units of frames with respect to the pixel group representative values.

16. The display device of claim 15, wherein the afterimage compensator includes:

a memory outputting the frame representative value of a previous frame and storing the frame representative value of a current frame.

17. The display device of claim 16, wherein the afterimage compensator includes:

a weight calculator determining the input grayscales designated as the first group, the first weight, the input grayscales designated as the second group, and the second weight based on a difference between the frame representative value of the current frame and the frame representative value of the previous frame and the pixel group representative values when the counted value is greater than a threshold value.

18. The display device of claim 16, wherein the afterimage compensator includes:

a weight calculator determining the input grayscales designated as the first group, the first weight, the input grayscales designated as the second group, and the second weight based on a difference between the pixel group representative values and the frame representative value of the previous frame when the counted value is greater than the threshold value.

19. A driving method of a display device comprising:

generating a still image detection signal when input grayscales correspond to a still image;

generating output grayscales by applying first and second weights to the input grayscales when the still image detection signal is generated; and displaying an image based on the output grayscales, wherein in the generating the output grayscales, applying the first weight having an initial value greater than 1 to the input grayscales designated as a first group, and converging the first weight to 1, and wherein in the generating the output grayscales, applying the second weight having an initial value less than 1 to the input grayscales designated as a second group, and converging the second weight to 1.

20. The driving method of claim 19, wherein a representative value of the input grayscales designated as the first group is smaller than a corresponding representative value of a previous frame, and wherein a representative value of the input grayscales designated as the second group is greater than the corresponding representative value of the previous frame.

* * * * *